US005289246A

United States Patent [19]

Menjo

[11] Patent Number: 5,289,246

[45] Date of Patent: Feb. 22, 1994

[54] COLOR MIXING AND FIXING DEVICE PREVENTING GLOSS UNEVENNESS

[75] Inventor: Takeshi Menjo, Tokyo, Japan

[73] Assignee: Canon Kabushiki Kaisha, Tokyo, Japan

[21] Appl. No.: 840,554

[22] Filed: Feb. 25, 1992

[30] Foreign Application Priority Data

Feb. 26, 1991 [JP] Japan ..... 3-53143
Jan. 20, 1992 [JP] Japan ..... 4-7554
Feb. 3, 1992 [JP] Japan ..... 4-17639

[51] Int. Cl.[5] ..... G03G 15/20

[52] U.S. Cl. ..... 355/285; 355/290; 355/284; 219/216

[58] Field of Search ..... 355/290, 289, 284, 285; 219/216, 469; 432/60; 118/60

[56] References Cited

U.S. PATENT DOCUMENTS

Re. 33,770 12/1991 Torino et al. ..... 355/290
4,814,819 3/1989 Torino et al. ..... 355/290
4,949,130 8/1990 Torino ..... 355/282
5,049,943 9/1991 Menjo et al. ..... 355/284
5,068,692 11/1991 Menjo ..... 355/284
5,075,732 12/1991 Menjo ..... 355/282

FOREIGN PATENT DOCUMENTS 55-17108 2/1980 Japan .

*Primary Examiner*—R. L. Moses
*Attorney, Agent, or Firm*—Fitzpatrick, Cella, Harper & Scinto

[57] ABSTRACT

A fixing device having a heating roller and a pressure roller each of which has an elastic layer provided thereon and which touch each other to form a nip. The elastic layer of the heating roller is thinner than that of the pressure roller, and/or the surface effective hardness of the heating roller is 85° or less and that of the pressure roller 85° or greater. The nip is substantially flat. The portion of a recording member exiting the nip proceeds along a path substantially away from the heating roller.

17 Claims, 8 Drawing Sheets

COLOR MIXING AND FIXING DEVICE PREVENTING GLOSS UNEVENNESS

BACKGROUND OF THE INVENTION

Field of the Invention

The present invention relates to a color mixing and fixing device which provides a full color image by thermally fixing a multicolor toner image formed on a transfer member by an image forming process as electrophotography, electrostatic recording, magnetic recording, etc.

Related Background Art

Recently, image forming apparatuses of a full color type, in addition to a monochromatic type, have been widely used. A full color image forming apparatus layers onto the transfer member a yellow toner image, a magenta toner image and a cyan toner image and fixes such layered toner images with heat and pressure.

A color toner used to produce a full color image must be easy to mix and also easy to melt when subjected to heat during processing, and it is preferable for the toner to be of a sharp-melt type which has a low softening point and a low viscosity when melted. Such sharp-melt toners expand the range of reproducible color and thus provide a color copy reproducing the original image with high fidelity. However, most of such sharp-melt type color toners tend to offset or transfer to the surface of a fixing roller because there is significant affinity.

A fixing device which performs color mixing fixation is illustrated in FIG. 6. In FIG. 6, a fixing roller 1 has an outside diameter of 40 mm, and comprises an aluminium-made core 5 and a 400 μm thick rubber elastic layer 6 provided on the core 5. As shown in FIG. 7, the rubber elastic layer 6 has a double-layer structure: the base layer 6-2 of phenyl HTV (high temperature vulcanization type) silicone rubber having a thickness of 360 μm; and the top layer 6-1 of phenyl LTV (low temperature vulcanization type) silicone rubber, the top layer for preventing the toner offsetting mentioned above and having a thickness of 40 μm. A pressure roller 2 has an outside diameter of 40 mm and is composed of an aluminium-made core 8 and an LTV silicone elastic layer having a thickness of about 6 mm and provided on the core 8. The surface thereof is covered with a fluorine-containing polymer tube having a thickness of 50 μm.

A release agent applying unit 3 comprises an oil pan 13 containing dimethyl silicone oil KF96 300CS (Shin-etsu Kagaku Kabushiki Kaisha) and a felt member 16 for conducting the oil to the surface of the fixing roller 1. A cleaner unit 4 comprises a known pressing roller 4-1 which presses the surface of the fixing roller 1 for cleaning, e.g. removing the toner transferred the surface thereof.

The fixing roller 1 is heated by a heater 11. The surface temperature of the fixing roller 1 is monitored by a thermistor 12 and maintained at 180° C. by a controller unit (not shown) switching the heater 11 on and off. The fixing roller 1 is rotated by a driver unit (not shown) in the direction indicated by the arrow in the FIG. 6. A transfer member P carrying a visible image (a toner image) formed of a plurality of layers is fed into the nip portion N between the pressure roller 2 and the fixing roller 1. Fixing roller 1 is heated and rotated, and thus the toner image is thermally fixed at the nip portion N.

Then, the transfer member P is conveyed out of the fixing device by discharge rollers 16.

FIG. 8 illustrates how the transfer member P goes through the nip N. A portion of the transfer member passing the nip N is curved along the surface of the fixing roller 1. Therefore, even after the toner T is fixed with heat at the nip N, it receives heat radiated from the fixing roller 1. Moreover, the fixed portion of the transfer member P sometimes sticks to the fixing roller 1 and rotates with it to a separator 14. Thus, the fixed toner receives excessive heat and melts or softens excessively, often resulting in an extremely glossy image or the toner offsetting (the transfer of toner to the fixing roller).

Such phenomena is hardly a problem in known monochromatic copying. The main purpose of monochromatic copying is to copy characters and drawings, and variations of the gloss are not a concern. Further, because the toner used in monochromatic copying has a high melting point, the gloss is unlikely to vary with variations of heating duration or the amount of heat the toner receives. Therefore, in a monochromatic copying machine, the pressure roller is made substantially softer than the heating roller so that a transfer member is conveyed along the heating roller surface to be discharged.

In multicolor copying, since a document (original) often has a solid image having a large area, variations of the heating duration cause visible unevenness of gloss in the toner solid image, and thus results in a poor, quality copy image. This problem is particularly acute when a sharp-melt type toner is used. Further, a sharp-melt toner tends to offset because it has a high affinity for the roller material. If the toner is heated longer than the duration of heating at the nip portion, the toner excessively melts and immediately offsets to the fixing roller.

SUMMARY OF THE INVENTION

An object of the present invention is to provide a color mixing and fixing device which substantially prevents gloss unevenness in full color images.

Another object of the present invention is to provide a color mixing and fixing device which substantially prevents toner offsetting due to the excess melting of toner.

Still another object of the present invention is to provide a color mixing and fixing device in which the point where a transfer member crosses the downstream-side common tangent line of the heating roller and the pressure roller is the intersection of the common tangent and a straight line passing both ends of the nip in the feeding direction, or a point on the common tangent line between the above-mentioned intersection and the contact point with the pressure roller.

A further object of the present invention is to provide a color mixing and fixing device in which the effective hardness of the heating roller surface is 85° or less and the effective hardness of the pressure roller surface is 85° or more.

An even further object of the present invention is to provide a color mixing and fixing device in which the difference between the effective hardnesses of the heating roller surface and the pressure roller surface is 10° or less.

A still further object of the present invention is to provide a color mixing and fixing device in which the thickness of the elastic layer of the heating roller is smaller that of the elastic layer of the pressure roller and in which the effective hardness of the heating roller surface is lower than the effective hardness of the pressure roller surface.

Other objects, features and advantages of the present invention will become apparent in the attached drawings, the detailed description of the preferred embodiments and the claims.

DETAILED DESCRIPTION OF THE PREFERRED EMBODIMENTS

Figure 9:
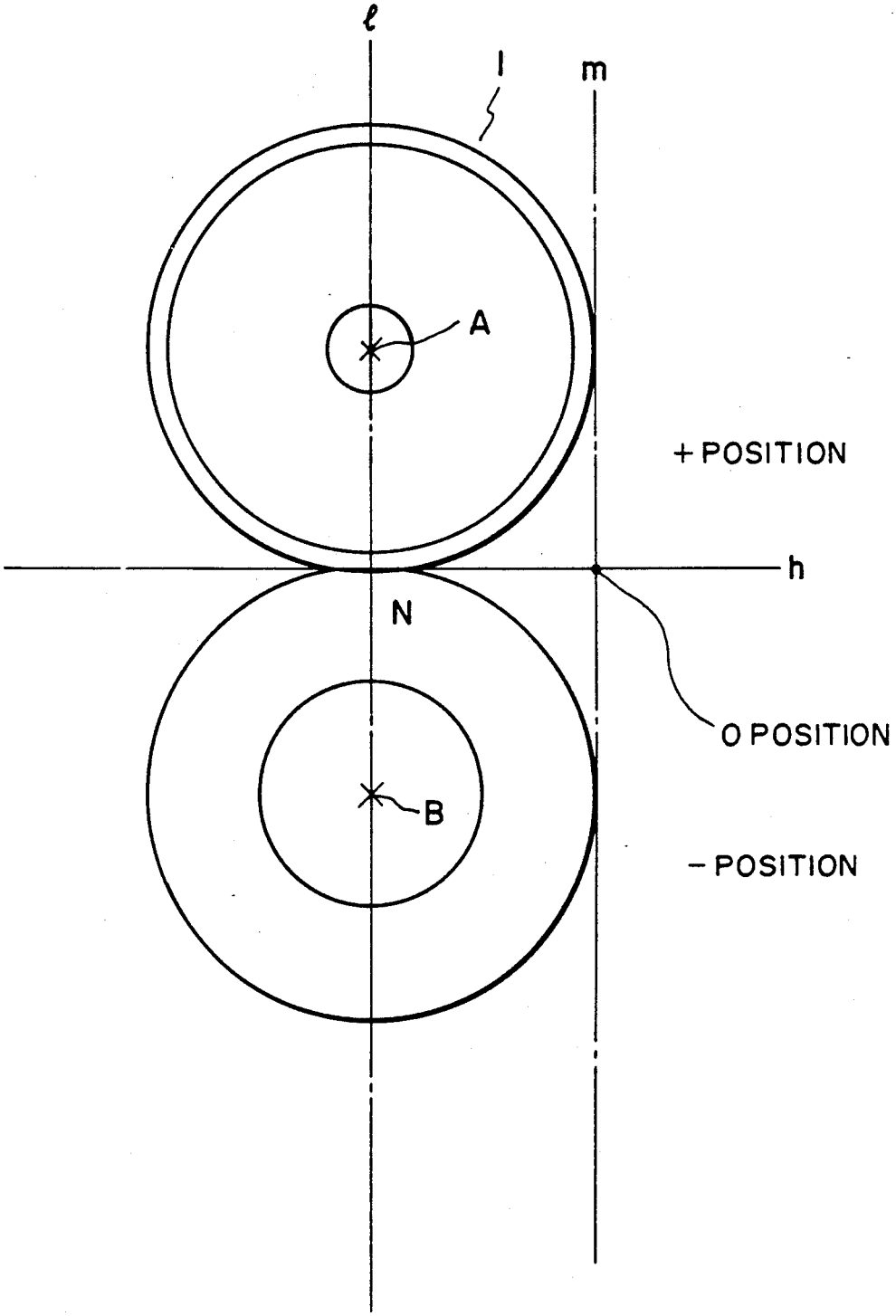
FIG. 9 illustrates the definition of the discharge position at roller end.

With reference to FIG. 9, the definition of the discharge position of a transfer member at the end of roller will be explained. A straight line l passes thru the centers A, B of a fixing roller 1 and a pressure roller 2, respectively. A line h perpendicular to the line l passes thru both ends of the nip. A common tangent m touches the fixing and pressure rollers at the down stream side. The tangent m is defined as a reference line for the discharge position at the roller end. The zero (0) position is defined at the intersection of the tangent m and the perpendicular line h. One side of the zero position where the fixing roller is placed is defined as a positive (+) position and the other side where the pressure roller is placed is defined as a negative (−) position.

Figure 8:
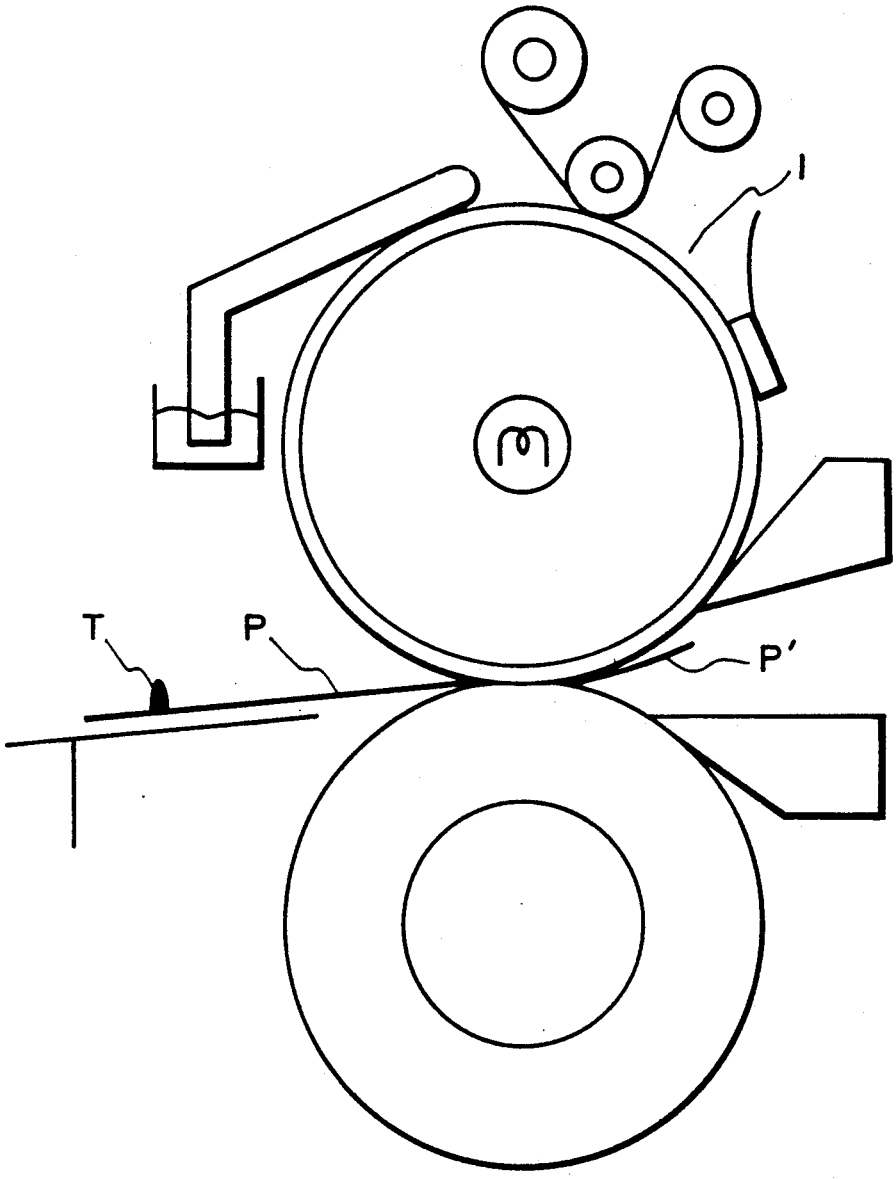
FIG. 8 is a sectional view of the device shown in FIG. 6, illustrating the discharge position of a transfer member at roller end.
Figure 10:
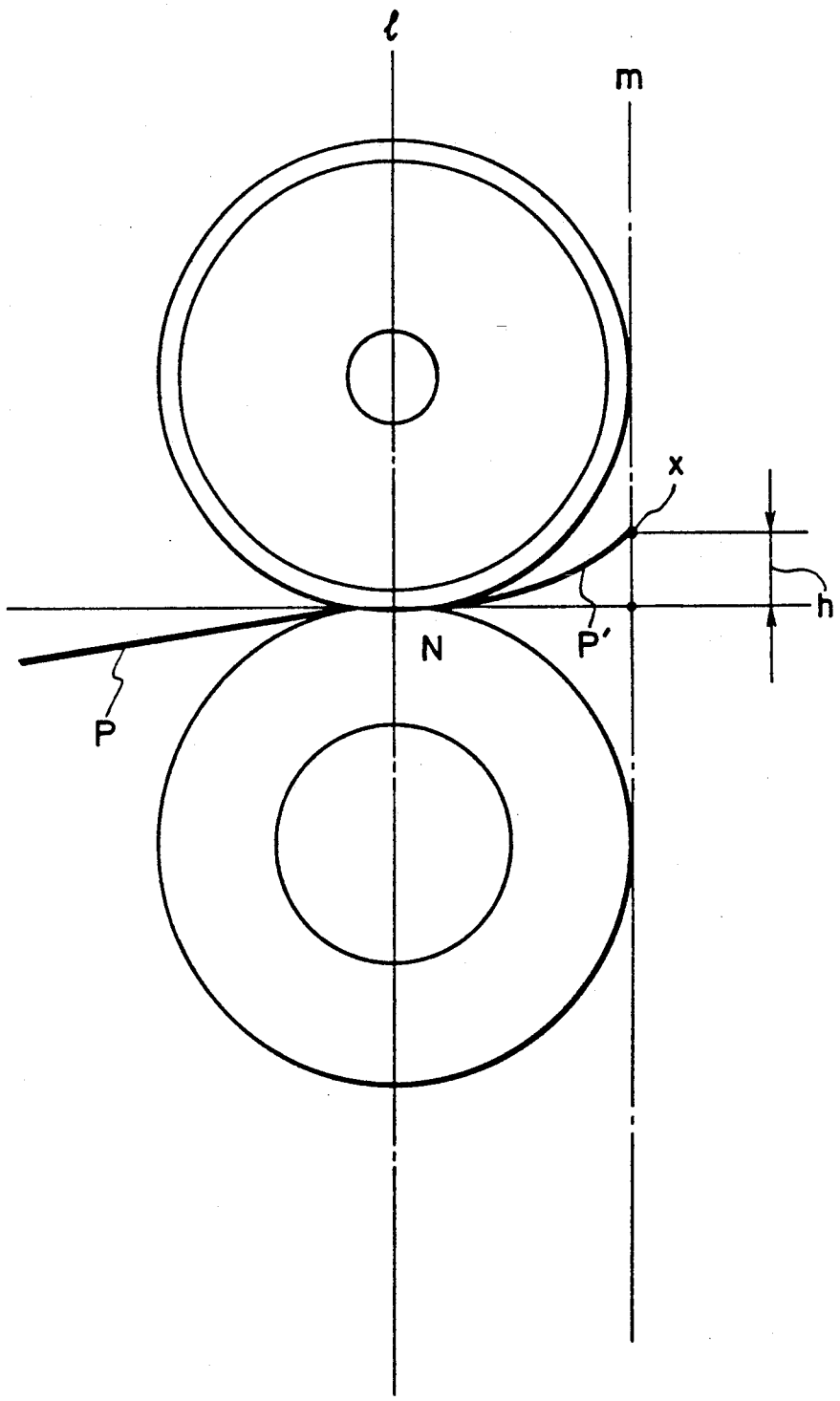
FIG. 10 illustrates an example where the discharge position at the roller end is at a positive position.

In such a positional system, the position at which a transfer member, having come through the nip, passes the reference line m is expressed as a distance from the zero position by the unit of mm, and such a position is defined as the discharge position at the roller end. For example, the discharge position of the transfer member P' in FIG. 8 is expressed as shown in FIG. 10. The transfer member P' intersects the tangent m at a point x, whose distance from the line h, i.e. from the zero position, is +5 mm. Thus, the discharge position of the fixing device is defined as +5 mm.

Figure 4:
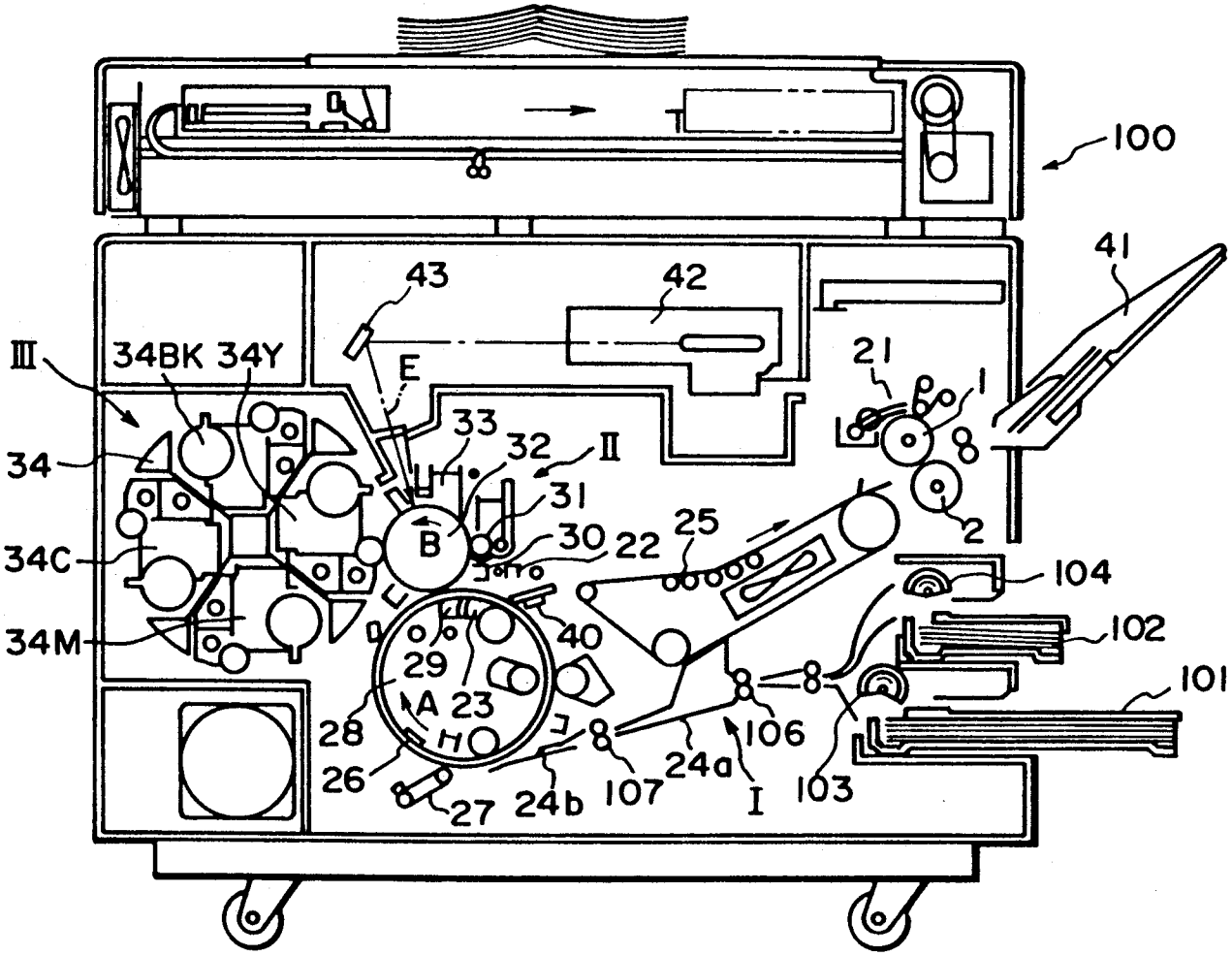
FIG. 4 is a sectional view of a full color electrophotographic image forming apparatus.

With reference to FIG. 4, a full color image forming apparatus employing a color mixing and fixing device to produce a multicolor image will be described. The apparatus produces a full color image by mixing different color toners.

As shown in the FIG. 4, the image forming apparatus 100 comprises: a transfer member feed system I extending from the right-hand side of the apparatus 100 to a center portion of the apparatus 100; a latent image forming section II provided at a central portion of the apparatus 100, closed to a transfer drum 28 of the transfer member feed system I; and a rotary developer section III provided adjacent to the latent image forming section II.

The transfer member feed system I will be described.

An opening is formed on the right-hand side wall of the apparatus 100. Trays 101, 102 for supplying transfer members are placed at the opening, with portions thereof sticking out of the apparatus 100. Feed rollers 103 and 104 are provided approximately directly over the trays 101 and 102, respectively. Feed rollers 106, 107 and feed guides **24*a*, 24*b* are alternately lined to connect the feed rollers 103, 104 to the transfer drum 28. The transfer drum 28 is provided at a central portion of the apparatus 100 and is rotatable in the direction indicated by an arrow A. An abutting roller 27, a gripper 26, a charger 22 for separating a transfer member from the drum, and a separator 40 are arranged immediately around the outer peripheral surface of the transfer drum 28, in the above-implied order in the rotational direction of the transfer drum 28. A transfer charger 29 and a charger 23 for separating a transfer member from the drum are provided adjacent to the inner peripheral surface of the transfer drum 28. Feed belt means 25 is provided approximately in the two o'clock direction from the transfer drum 28, close to the separator 40. A multicolor image fixing device (hereinafter referred to as a "fixing device") 21 is provided at the downstream end (right-hand side end) of the feed belt means 25. A tray 41 is provided further downstream from the fixing device 21. The tray 41 extends out of the apparatus 100 and is detachable from the apparatus 100**.

The construction of the latent image forming section II will be described.

A photosensitive drum 32 rotatable in the direction indicated by an arrow B in FIG. 4 is an image carrier. The outer peripheral surface of the photosensitive drum 32 abuts on the outer peripheral surface of the transfer drum 28. A charger 30 for discharging, cleaning means 31 and a first-stage charger 33 are provided above the photosensitive drum 32, adjacently to the outer peripheral surface thereof, and arranged in the above-implied order in the rotational direction of photosensitive drum 32. An image exposing means 42, such as laser beam generator, and image exposure light reflecting means 43 are provided above the photosensitive drum 32, which are for forming a latent image on the outer peripheral surface of the photosensitive drum 32.

The construction of the rotary developer section III will be described.

A rotatable body (hereinafter referred to as a "rotor") 34 is provided facing the outer peripheral surface of the photosensitive drum 32. Four different developing units are radially arranged in the rotor 34. These developing units visualize, i.e. develop, a latent image formed on the outer peripheral surface of the photosensitive drum 32. The four developing units are a yellow developing unit 34Y, a magenta developing unit 34M, a cyan developing unit 34C and a black developing unit 34BK.

The operational sequence of the above-described image forming apparatus will be explained in a case where the operation is in full color mode. When the photosensitive drum 32 is rotated in the direction indicated by the arrow B in FIG. 4, the first stage charger 33 evenly charges the photosensitive drum 32. The evenly charged photosensitive drum 32 is exposed to laser rays E modulated by yellow image signals from a document, and a yellow latent image is formed thereon. The yellow latent image is developed by the yellow developing unit 34Y, which is brought to the development position beforehand by the rotation of the rotor 34.

On the other hand, a transfer member (not shown) is brought through the feed rollers 106, the feed guide 24*a*, the feed rollers 107 and the feed guide 24*b*, to be gripped by the gripper 27 of the transfer drum 28 according to a designated timing. The transfer member is electrostatically drawn onto and rolled around the transfer drum 28 by means of the abutting roller 27 and an electrode facing the abutting roller 27. The transfer drum rotates in the direction indicated by the arrow A in FIG. 4, abutting the photosensitive drum 32. The visualized image (the toner image) developed on the photosensitive drum 32 by the yellow developing unit 34Y is transferred to the transfer member on the transfer drum 29 at the abutting portion therebetween by the transfer charger 29. The transfer drum 28 carrying the transfer member continues rotating for the next color (magenta in FIG. 4) transfer.

The photosensitive drum 32 is discharged by the discharging charger 30 and cleaned by the cleaning means. Then, the photosensitive drum 32 is charged by the first-stage charger 33 again and exposed to laser rays E modulated by magenta image signals. While the latent image is being formed on the photosensitive drum 32 according to the magenta image signals, the rotary developing section III rotates to bring the magenta developing unit 34M to the development position. Then, magenta development is performed, and the magenta toner image is transferred to the transfer member as described above. The same procedure is repeated for cyan and black toner images. When all the four color toner images are transferred, the four-color visualized image (the toner image) is discharged by the separating chargers 22 and 23. The transfer member is released from the gripper 26 and separated from the transfer drum 28 by the separator 40. Then, the transfer member is conveyed by the feed belt means 25 to the fixing device 21, where the toners of the four-color visualized image are melted, mixed, and then fixed by means of heat and pressure. The full-color printing sequence is thus completed to produce a full-color printed image.

The color toners used in the full-color printing sequence are of a sharp-melt type since it is required that such toners be easy to melt and mix when subjected to heat.

The sharp-melt toners are produced, for example, by melt-kneading, milling and classifying the following toner compounds: coloring agents (dye, sublimation dye), charge control agents, binding resins such as polyester resin or styrene-acryl ester resin, etc. Various additives, for example, hydrophobic colloidal silica, may be added. It is preferable that polyester resin be contained as the binding resin in the color toner, since it will provide the toner with a favorable fixing property and a sharp melt property. An example of a sharp melt type polyester resin is a high molecular weight compound which is formed of a diol compound and a dicarboxylic acid and which has the ester coupling site on its principal chain. More preferable is a polyester resin formed by the copolycondensation of carboxylic acid compounds including a carboxylic acid having two or more carboxyl groups, an anhydride of such a carboxylic acid or a lower alkyl ester of the same (e.g. fumaric acid, maleic acid, maleic acid anhydride, phtalic acid, terephtalic acid, trimellitic acid and pyromellitic acid), and a diol compound which is a bisphenol derivative or the substitution product of a bisphenol derivative represented by the following formula:

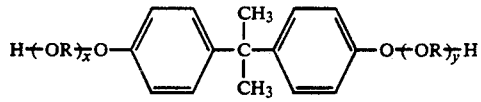

where: R is an ethylene or propylene group; x, y are natural numbers, and the average of x and y is 2 to 10. Such a polyester resin has a sharp melting property. The softening point of the sharp-melt type polyester resin is preferably 75° to 150° C., and more preferably 80° to 120° C.

Figure 5:
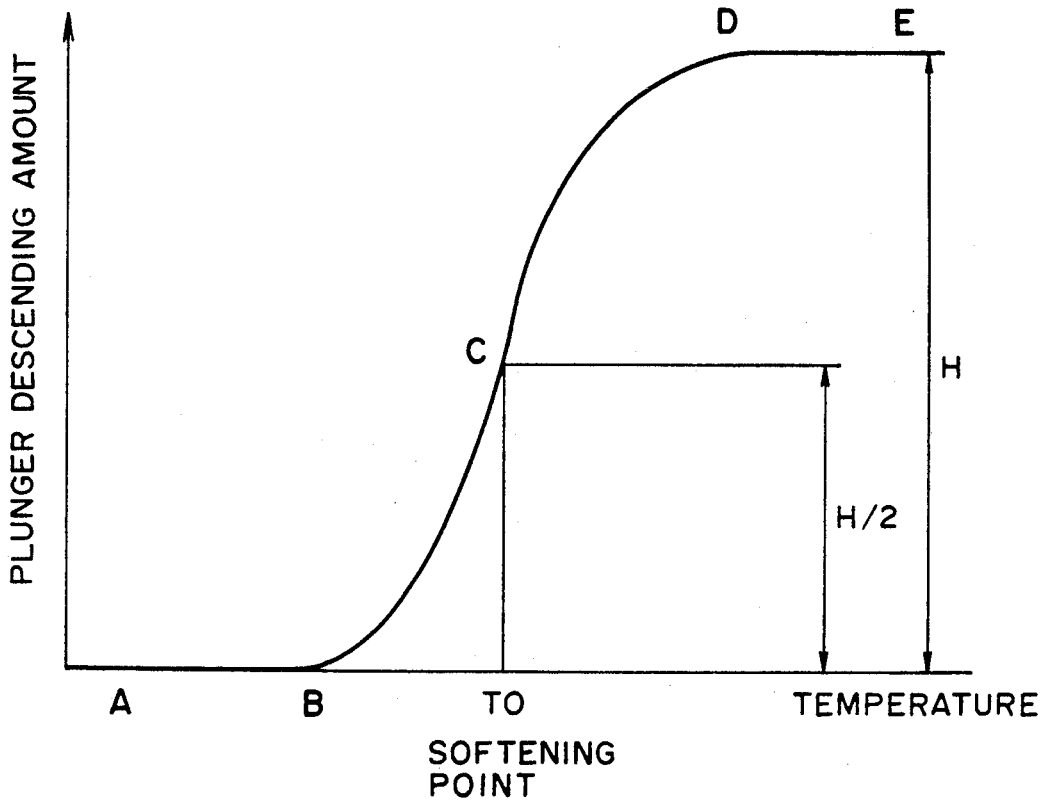
FIG. 5 is a graph showing the softening S-curve of a sharp-melt toner used in the apparatus illustrated in FIG. 4.

FIG. 5 shows the softening property of a sharp-melt toner containing such a polyester resin as the binding resin. The measurement was carried out under the following conditions.

One to three grams of fine powder of a specimen toner was precisely weighed, put in a die (nozzle) having a diameter of 0.2 mm and a thickness of 1.0 mm, and pressed by a load of 20 kg for extrusion. After the die was pre-heated for 300 sec. at the initial set temperature of 70° C., the temperature of the die was raised at a constant rate of 6° C./min. to obtain a curve showing the relation between the temperature and the plunger descending amount (hereinafter referred to a "softening S-curve"). The sectional area of the plunger was 1.0 $cm^2$. As shown in FIG. 5, as the temperature increased at the constant rate, the toner was gradually heated and started to flow out (the plunger descended A→B). When the temperature increased further, the toner melted and flowed out at a greater rate (B→C→D), and then, the plunger completed the descent (D →E).

The height H of the S-curve represents the total outflow, and the temperature T0 corresponding to a point C at a height of H/2 indicates the softening point of the toner or the resin. Whether or not a toner or a binding resin has a sharp-melt property can be judged by studying measurements of the apparent viscosity of the melted toner or resin.

Such toner or binding resin having a sharp-melt property satisfies the following conditions:

$$T1 = 90° \text{ to } 150° \text{ C.}$$

$$|\Delta T| = |T1 - T2| = 5° \text{ to } 20° \text{ C.}$$

where T1 and T2 are temperatures of the toner or the binding resin when the apparent melt viscosity is $10^3$ poise and $5 \times 10^2$ poise, respectively.

A sharp-melt type resin, having such a temperature-melt viscosity property as described above, characteristically shows a substantially sharp fall in viscosity when it is heated. Such a fall in viscosity enables appropriate mixture of a top-layered toner and a base-layered toner and substantially increases transparency of the toner layer, resulting in a favorable subtractive color mixture.

First Embodiment

The first embodiment of the present invention will be described hereinafter with reference to FIGS. 1 to 3.

Figure 1:
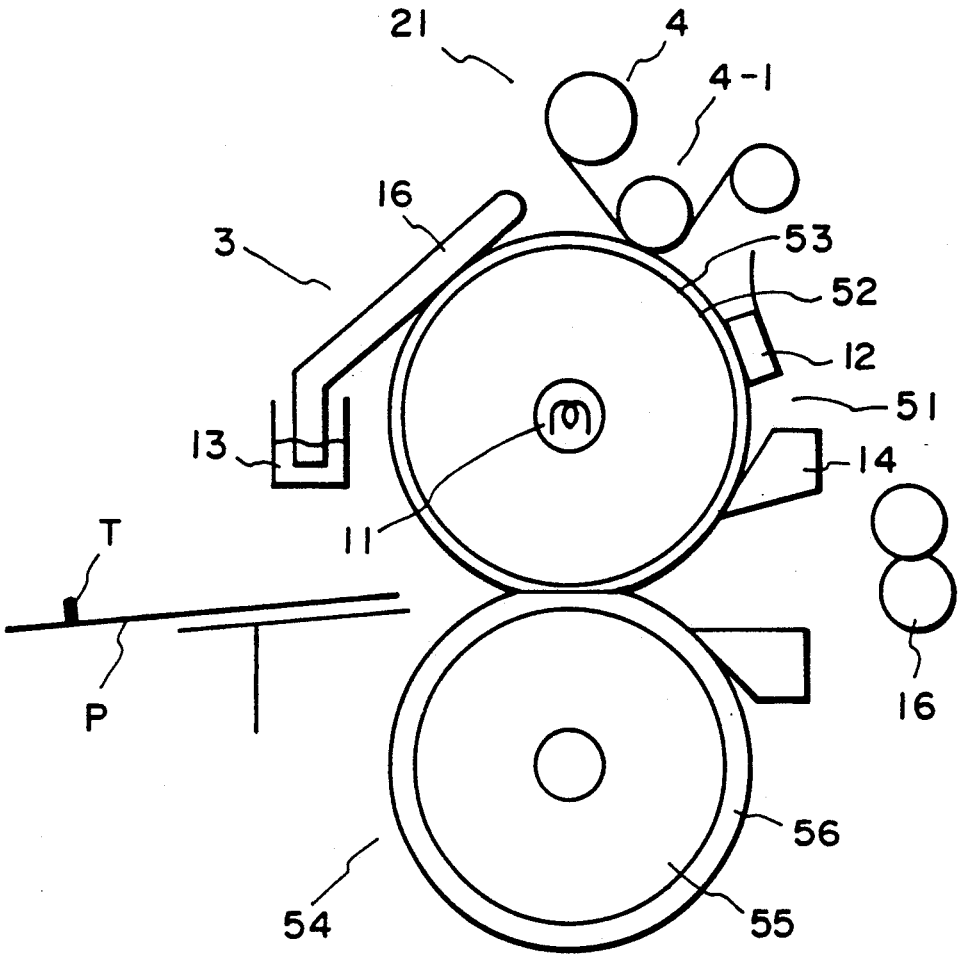
FIG. 1 is a schematic sectional view of a color mixing and fixing device according to the first embodiment of the present invention.
Figure 2:
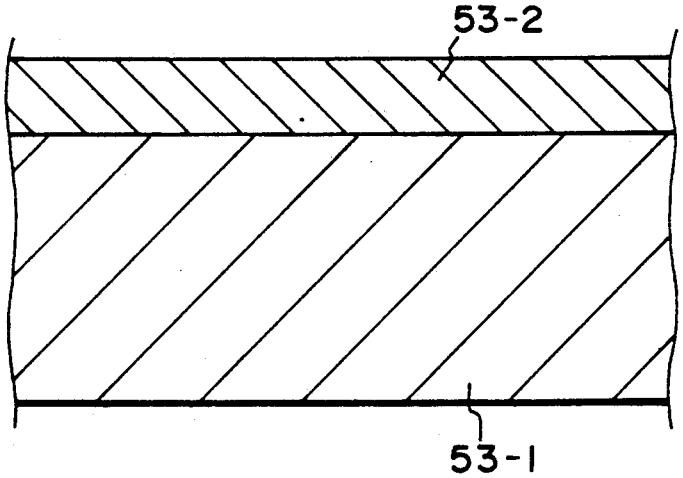
FIG. 2 is a sectional partial view of an elastic layer of a fixing roller of the device shown in FIG. 1.

Referring to FIG. 1, a multicolor image fixing device according to the first embodiment has a fixing roller 51 having an outside diameter of 40 mm and comprising an aluminium core 52 and an elastic layer 53 having a thickness of 1 mm and formed on the core 52. As shown in FIG. 2, the elastic layer 53 is composed of two elastic layers: the base layer 53-1 of phenyl HTV silicon rubber having a thickness of 800 μm; and the top layer 53-2 of single-liquid type RTV (room temperature vulcanization type) silicon rubber, a layer for preventing the toner offsetting, having a thickness of 200 μm.

The two rubbers constituting the elastic layer 53 are selected so that the effective hardness of the fixing roller is approximately 80° (Asker-C 1 kg load): the piece rubber hardness of the base layered phenyl HTV silicone rubber is approximately 34° (JIS-A 1 kg load); and the piece rubber hardness of the top layered single-liquid type RTV silicone rubber is approximately 50°.

The effective hardness (Asker-C 1 kg load) of the fixing roller is taken by measuring a surface hardness of the elastomer (rubber) layer fixed onto the aluminium core. In other words, a value of the effective hardness includes the hardness of the aluminium core. The hardness of rubber for each layer is taken by measuring the hardness of the rubber alone according to the JIS standard. Thus, when the elastic layer is thin as in this fixing roller, the surface effective hardness of the roller becomes greater than the hardness of the rubber as measured according to the JIS standard. While the piece rubber hardness was measured by the JIS-A method according to the JIS standard, the effective hardness of a roller was measured under a load of 1 kg with an Asker-C hardness meter in order to avoid damage to the roller.

A pressure roller 54 has an outside diameter of 40 mm and comprises an aluminium core 55, and an elastic layer 56 of phenyl HTV silicone rubber 56 having a thickness of about 2 mm and formed on the core 55. The surface thereof is covered with a fluorine-containing polymer tube having a thickness of 50 μm. Rubber materials for the two layers are selected so that the surface effective hardness of the pressure roller becomes 86° (Asker-C 1 kg load). For example, the phenyl HTV silicone rubber having a hardness of about 70° (JIS-A 1 kg load) is used for the base layer.

The oil applying unit, cleaning unit, heating unit and temperature control unit are basically the same as those in the conventional art, and thus, the description thereof will be omitted.

The fixing roller 51 is provided with a heater 11, but the pressure roller 54 is not provided with a heater. Naturally, the toner on a transfer member receives more heat from the fixing roller 51 than from the pressure roller 54.

Figure 3:
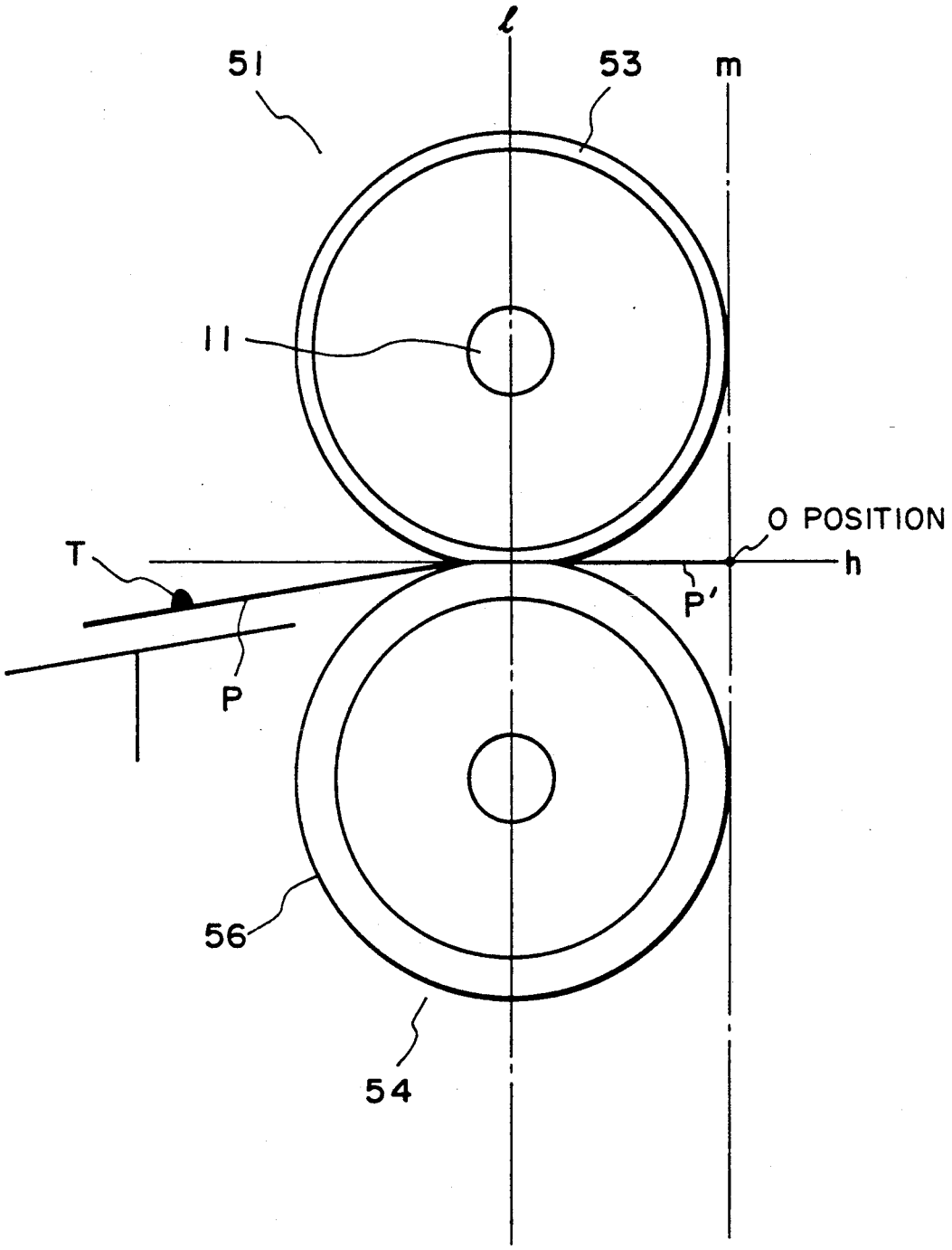
FIG. 3 is a sectional view of a portion of the device shown in FIG. 1, illustrating the discharge position of a transfer member at roller end.

Referring to FIG. 3, a transfer member P carrying a multicolor toner image T, which is formed by the known full-color electrophotographic image forming process, is conveyed into the nip N between the two rollers which are rotated and heated. The toner image is mixed and fixed at the nip N. The portion of the transfer member p exiting the nip N passes the zero or negative position at the rollers' tangent, as shown in FIG. 3. Thus, after passing the nip N, the transfer member P does not receive excessive heat radiating from the fixing roller 51.

According to this embodiment, the zero or negative discharge position at the roller end can be obtained, since the nip N is made substantially flat by employing fixing and pressure rollers having proper diameters, and elastic layers having proper thicknesses and providing proper effective hardnesses. To obtain a flat nip N, the pressure roller having a thick elastic layer on the core in order to provide a wider nip is supposed to have a surface effective hardness of 85° or greater, and the fixing roller having an elastic layer thinner than that of the pressure roller is supposed to have a surface effective hardness of 85° or less.

Since the total thickness of the elastic layer of the fixing roller is less than that of the pressure roller, it is preferable that the surface effective hardness of the fixing roller be less than that of the pressure roller. Further, the piece hardness of the elastic layer of the fixing roller should preferably be less than that of the pressure roller.

The discharge position at the roller end is not dependent on the kinds of transfer member used. The variations of the stiffness of transfer members do not substantially affect the discharge position because the distance from the nip to the roller end line is small according to the present invention. However, it is preferable that sheets of paper of 40 to 120 g be used in the measurement of the discharge position. In the experiments according to this invention, 84 g sheets of paper of size A4 (21×29.7 cm) were used.

Figure 6:
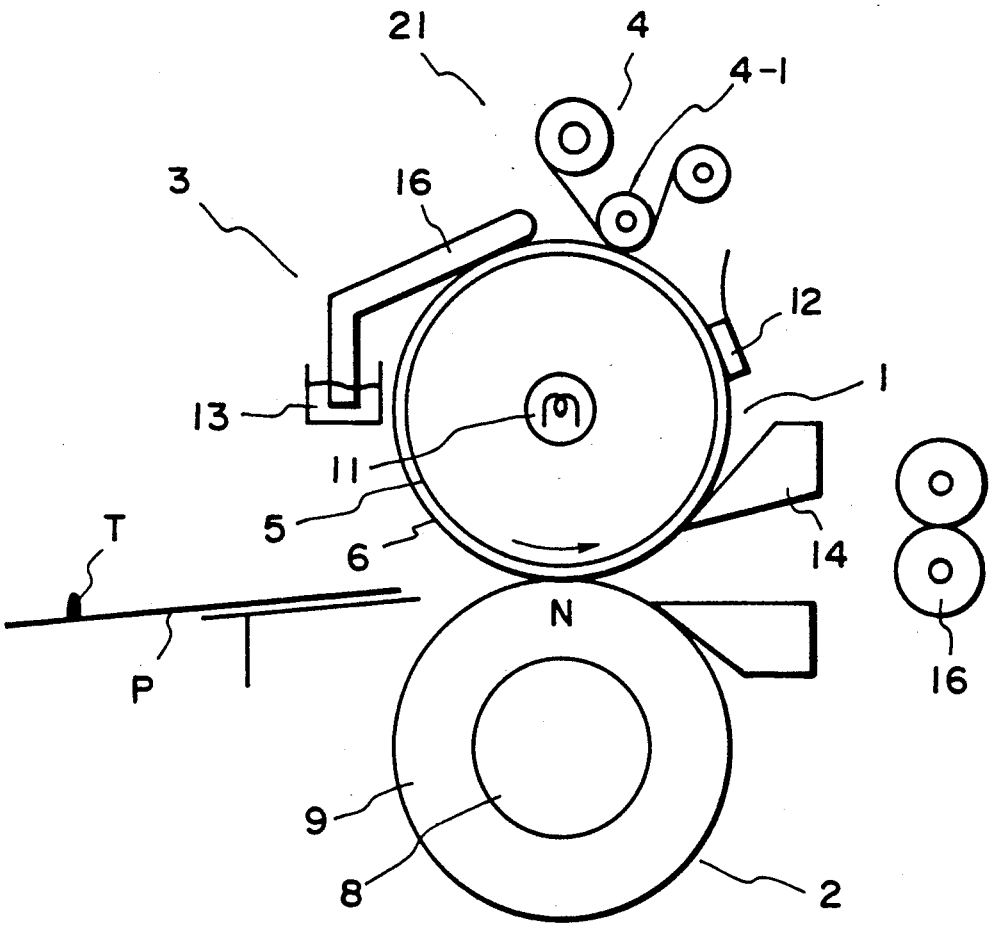
FIG. 6 is a schematic sectional view of a multi-color image fixing device employed in the apparatus shown in FIG. 4.
Figure 7:
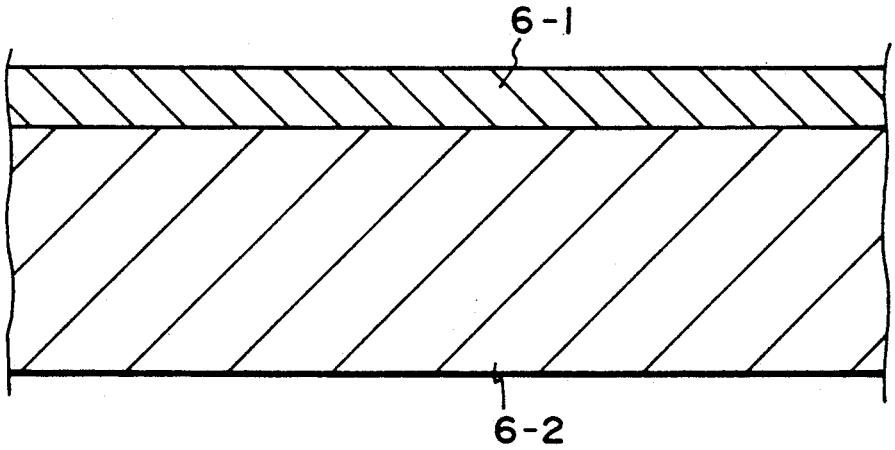
FIG. 7 is a sectional partial view of an elastic layer of a fixing roller of the device shown in FIG. 6.

Comparison between the fixing device of this embodiment and the conventional fixing device shown in FIG. 6 is shown below.

| | Embodiment | Conventional |
|---|---|---|
| [Fixing Roller] | | |
| Outer diameter | 40 mm | 40 mm |
| Elastic Layer Thickness | 1 mm | 0.4 mm |
| Base-Layered Elastomer | 800 μm | 360 μm |
| Top-Layered Releaser | 200 μm | 40 μm |
| Surface Effective Hardness (Asker-C 1 kg load) | 80° | 93° |
| Piece Elastomer Hardness (JIS-C 1 kg load) | 50° | 50° |
| [Pressure Roller] | | |
| Outer diameter | 40 mm | 40 mm |
| Elastic Layer Thickness | 2 mm | 6 mm |
| Fluororesin Tube | 50 μm | 50 μm |
| Surface Effective Hardness (Asker-C 1 kg load) | 86° | 70° |
| Piece Elastomer Hardness (JIS-C 1 kg load) | 70° | 60° |
| [Discharge Position] | 0 mm | + position |

When the above conventional device was used to fix a solid image in which toner covered the entire surface of the transfer member, gloss unevenness occurred all over the surface, and only 2,000 sheets of paper were processed before offsetting, i.e. transfer of toner from a paper sheet to the fixing roller, occurred. When the fixing device of this embodiment was used, no gloss unevenness occurred in the solid image, and the number of the sheets of paper processed before offsetting occurred increased to 20,000.

A comparative example is shown below. The thicknesses of the elastic layers of the fixing and pressure rollers used in the comparative example were respectively the same as those in this embodiment.

| | Embodiment | Comparative Ex. |
|---|---|---|
| [Fixing Roller] | | |
| Outer diameter | 40 mm | 40 mm |
| Elastic Layer Thickness | 1 mm | 1 mm |
| Base-Layered Elastomer | 800 μm | 800 μm |
| Top-Layered Releaser | 200 μm | 200 μm |
| Surface Effective Hardness (Asker-C 1 kg load) | 80° | 80° |
| Piece Elastomer Hardness (JIS-C 1 kg load) | 50° | 34° |
| [Pressure Roller] | | |
| Outer diameter | 40 mm | 40 mm |
| Elastic Layer Thickness | 2 mm | 2 mm |
| Fluororesin Tube | 50 μm | 50 μm |
| Surface Effective Hardness (Asker-C 1 kg load) | 86° | 83° |
| Piece Elastomer Hardness (JIS-C 1 kg load) | 70° | 60° |
| [Discharge Position] | 0 mm | +2 mm |

As shown in the above table, the surface effective hardness of the fixing roller is less than that of the pressure roller, both in the embodiment and in the comparative example.

When a color image formed by the known full-color electrophotographic image forming process as described above was fixed by the comparative device as shown in the above table, offsetting occurred when 6,000 sheets of paper were printed. Though the surface effective hardness of the fixing roller is less than that of the pressure roller, the discharge is made in a positive position (+2 mm) in the comparative example. Therefore, offsetting occurs even with a small number of printed sheets if a color toner is used, which makes it difficult for the paper to be released from the transfer drum, or if a plurality of toner layers are carried by a transfer member. To substantially prevent the occurrence of gloss unevenness and offsetting and thus to prolong the service life of the fixing device which processes multicolor images, the discharge position at the roller end must be properly set, more delicately than in the conventional heat-fixing device.

The discharge position is set in a negative position in the Canon-made NP-Color T and Color Laser Copier-1 by employing a thicker elastic layer on the fixing roller than on the pressure roller. In such a construction, however, the elastic layer of the fixing roller inevitably becomes thick, i.e. 2 mm at least. In operation, the temperature of the core becomes substantially higher than the temperature of the elastic layer, and thus the elastic layer of the fixing roller could deteriorate due to the excessive heat. Also, the thick elastic layer hinders heat conduction from the heater to the surface. When the surface temperature of such a roller is lowered by a paper sheet conveyed thereon, it takes time for the surface temperature to rise again. In such a case, a malfixation may result.

Though a fixing device may be provided with a heating means for externally heating the fixing roller in order to solve such problems, the construction of such a device would be complicated, and thus it would be difficult to achieve sufficient reliability. Therefore, it is preferable to employ a fixing roller having an elastic layer thinner than that of the pressure roller, as in the present invention. The preferred thickness of the elastic layer of the fixing roller is less than 2 mm.

Second Embodiment

The second embodiment of the present invention will be described. The description of common parts or features with the first embodiment will be omitted.

A color image was fixed by using the same fixing roller 51 as in the first embodiment and a pressure roller as follows:

Outer diameter of 40 mm;
elastic layer thickness of 3 mm;
surface fluororesin tube of 50 μm;
surface effective hardness of 87° (Asker-C 1 kg load);
piece elastomer hardness of 80° (JIS-A 1 kg load).

The discharge position at the roller end was 0 mm, and 20,000 sheets of paper were printed normally.

Other embodiments and comparative examples are shown in the below table.

| | Fixing rubber thickness | Roller surface hardness | Pressure rubber thickness | Roller surface hardness | Discharge position | Gloss Unevenness Offset |
|---|---|---|---|---|---|---|
| Conventional | 0.4 t | 93° | 6 t | 70° | on roller | x |
| Embodiment 1 | 1 t | 80° | 2 t | 86° | 0 mm | ○ |
| Embodiment 2 | 1 t | 80° | 3 t | 87° | 0 mm | ○ |
| Comparison 1 | 1 t | 80° | 2 t | 83° | +2 mm | x |
| Comparison 2 | 1 t | 88° | 2 t | 80° | +5 mm | x |
| Embodiment 3 | 1 t | 85° | 2 t | 90° | 0 mm | ○ |
| Embodiment 4 | 1 t | 80° | 2 t | 85° | 0 mm | ○ |
| Embodiment 5 | 1 t | 80° | 2 t | 95° | 0 mm | ○ |
| Embodiment 6 | 1 t | 80° | 2 t | 100° | −2 mm | ○ |
| Embodiment 7 | 1 t | 70° | 2 t | 100° | −4 mm | ○ |
| Embodiment 8 | 1 t | 60° | 2 t | 100° | −6 mm | ○ |
| Embodiment 9 | 1 t | 50° | 2 t | 100° | −7 mm | ○ |
| Embodiment 10 | 1 t | 40° | 2 t | 100° | −8 mm | ○ |
| Embodiment 11 | 1 t | 85° | 2 t | 85° | 0 mm | ○ |
| Comparison 3 | 1 t | 86° | 2 t | 84° | +1 mm | x |

Although the sheets in Embodiments 5 to 10 were discharged without rolling around the fixing rollers, there was a tendency for malfunctions, such as paper wrinkling or creasing, to occur due to the large differences between the surface effective hardnesses of the fixing rollers and the pressure rollers, with the least difference being 15°. To substantially prevent paper wrinkling, it is preferable that the difference between the surface effective hardnesses be 10° or less.

Because the individual hardness of the elastomer of the elastic layer of the fixing roller in either one of Embodiments 9 and 10 was less than 20°, restoration from pressure-caused deformation became significantly difficult. Thus, it is preferable that the surface effective hardness of the fixing roller be 60° or greater. Further, the surface effective hardness of the pressure roller should be 100° or less because an excessively great surface effective hardness of the pressure roller fails to provide a sufficiently wide nip.

Although a double-layered elastic layer is provided on the core of the fixing roller in each of the above embodiments, the elastic layer may be composed of a single layers, or three or more layers.

If it is necessary that a large amount of release agent oil be applied to the surface of the fixing roller, it is preferable that the elastic layer be composed of three or more layers including an interposed layer of an oil-shielding material such as fluorine-containing rubber. For favorable heat conduction from the internal heater to the surface of the fixing roller, it is preferable that the thermal conductivity of the elastomer be $1.0\times10^{-3}$ cal/cm.sec.°C. or greater. Although a surface-coating fluororesin tube is used on the pressure roller in the above embodiments, a known material, such as silicon rubber or fluorine-containing rubber, may be used instead, with variations of the thickness of such a tube being permissible. However, to smoothly feed transfer members and, in particular, to avoid wrinkling, it is preferable that a fluororesin tube having a thickness of 20 to 120 μm be provided on the surface of the pressure roller.

The outer diameters of the fixing and pressure rollers may be other than the value shown, i.e. 40 mm. Also, thicknesses of the elastic layers are not limited to the values shown: 1 mm and 1.5 mm for the elastic layer of the fixing roller; and 2 mm and 3 mm for that of the pressure roller.

While the present invention has been described with respect to what is presently considered to be preferred embodiments, it is to be understood that the invention is not limited to the disclosed embodiments. To the contrary, the invention is intended to cover various modifications and equivalent arrangements included within the spirit and scope of the appended claims.

What is claimed is:

1. A color mixing and fixing device, comprising:

a fixing roller for contacting a plurality of accumulated non-fixed toner images, said fixing roller having a heating source therein and comprising a core member and a surface rubber layer; and a pressure roller forming a nip together with said fixing roller, said pressure roller comprising a core member and an elastic layer provided thereon;

wherein a total thickness of the elastic layer of said fixing roller is less than a total thickness of the elastic layer of said pressure roller, and the surface effective hardness of said fixing roller is less than the surface effective hardness of said pressure roller.

2. A color mixing and fixing device according to claim 22, wherein the elastic layer of said fixing roller is composed of a plurality of layers.

3. A color mixing and fixing device according to claim 2, wherein the elastic layer of said fixing roller includes an HTV silicone rubber layer and an RTV silicone rubber layer provided on top of said HTV silicone rubber layer.

4. A color mixing and fixing device according to claim 1, wherein the elastic layer of said pressure roller is composed of a plurality of layers.

5. A color mixing and fixing device according to claim 4, wherein the elastic layer of said pressure roller includes an HTV silicone rubber layer and a fluorine-containing resin layer provided on top of said HTV silicone rubber layer.

6. A color mixing and fixing device according to claim 1, wherein the total thickness of the elastic layer of said fixing roller is less than 2 mm.

7. A color mixing and fixing device according to claim 1, wherein said toners are of a sharp-melt type.

8. A color mixing and fixing apparatus according to claim 1, wherein the surface effective hardness of said fixing roller is 60°–85° and the surface effective hardness of said pressure roller is 85°–100°.

9. A color mixing and fixing apparatus according to claim 8, wherein the piece hardness of an elastomer forming the elastic layer of either one of said fixing roller and said pressure roller is greater than 15°.

10. A color mixing and fixing apparatus according to claim 9, wherein the surface effective hardness of said fixing roller and said pressure roller differ by less than 10°.

11. A color mixing and fixing apparatus according to claim 10, wherein the elastic layer of said fixing roller is comprised of a HTV silicon rubber layer and a RTV silicone rubber layer provided on a top of the HTV silicone rubber layer.

12. A color mixing and fixing apparatus according to claim 8, wherein the elastic layer of said pressure roller is comprised of a plurality of layers.

13. A color mixing and fixing apparatus according to claim 12, wherein the elastic layer of said pressure roller is comprised of a HTV silicone rubber layer and a fluorine-containing resin layer provided on top of the HTV silicone rubber layer.

14. A color mixing and fixing apparatus according to claim 8, wherein the total thickness of the elastic layer of said fixing roller is less than 2 mm.

15. A color mixing and fixing apparatus according to claim 8, wherein the toners are sharp-melt types.

16. A color mixing and fixing apparatus according to claim 8, wherein the surface effective hardness of said fixing roller is 60°–85° and the surface effective hardness of said pressure roller is 85°–100°.

17. A color mixing and fixing apparatus according to claim 6, wherein the piece hardness of an elastomer forming the elastic layer of one of said fixing roller and said pressure roller is greater than 15°.

* * * * *

UNITED STATES PATENT AND TRADEMARK OFFICE

CERTIFICATE OF CORRECTION

PATENT NO. : 5,289,246
DATED : February 22, 1994
INVENTOR(S) : TAKESHI MENJO

It is certified that error appears in the above-indentified patent and that said Letters Patent is hereby corrected as shown below:

Column 2,
Line 29, "poor," should read --poor--.

Column 3,
Line 39, "roller" should read --a roller--;
Line 40, "thru" should read --through--; and
Line 44, "thru" should read --through--.

Column 6,
Line 4, "phtalic" should read --phthalic--;
Line 5, "terephtalic" should read --terephthalic--;
Line 35, "a" should read --as--; and
Line 64, "enables" should read --enables an--.

Column 11,
Line 10, "layers," first occurrence should read --layer,--.

Column 12,
Line 2, "claim 22," should read --claim 1,--; and
Line 57, "claim 6," should read --claim 16,--.

Signed and Sealed this

Fourth Day of October, 1994

Bruce Lehman

*Attest:*

BRUCE LEHMAN

*Attesting Officer*

*Commissioner of Patents and Trademarks*